US008823216B2

(12) United States Patent
Fukunaga

(10) Patent No.: US 8,823,216 B2
(45) Date of Patent: Sep. 2, 2014

(54) SIGNAL TRANSMISSION DEVICE, FILTER, AND INTER-SUBSTRATE COMMUNICATION DEVICE

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 583 days.

(21) Appl. No.: 13/222,704

(22) Filed: Aug. 31, 2011

(65) Prior Publication Data

US 2012/0049649 A1 Mar. 1, 2012

(30) Foreign Application Priority Data

Aug. 31, 2010 (JP) ..... 2010-194557

(51) Int. Cl.
*H01F 27/42* (2006.01)

(52) U.S. Cl.
USPC ..... 307/104

(58) Field of Classification Search
USPC ..... 307/104
See application file for complete search history.

(56) References Cited

FOREIGN PATENT DOCUMENTS

| | | |
|---|---|---|
| JP | A-2001-523412 | 11/2001 |
| JP | A-2002-185206 | 6/2002 |
| JP | A-2008-067012 | 3/2008 |
| JP | A-2008-271606 | 11/2008 |
| JP | A-2010-206319 | 9/2010 |
| JP | A-2010-206320 | 9/2010 |
| WO | WO 98/48473 A1 | 10/1998 |

*Primary Examiner* — Robert L. Deberadinis
(74) *Attorney, Agent, or Firm* — Oliff PLC

(57) ABSTRACT

In a signal transmission device, first open-ended resonators include a first first-open-ended resonator and a second first-open-ended resonator, in which open ends of the first first-open-ended resonator face a central portion of the second first-open-ended resonator, and a central portion of the first first-open-ended resonator faces open ends of the second first-open-ended resonator. When second open-ended resonators are employed, the second open-ended resonators include a first second-open-ended resonator and a second second-open-ended resonator, in which open ends of the first second-open-ended resonator face a central portion of the second second-open-ended resonator, and a central portion of the first second-open-ended resonator faces open ends of the second second-open-ended resonator. The first and the second open-ended resonators in closest proximity to each other in the first resonator are arranged such that the respective open ends thereof face each other and the respective central portions thereof face each other.

7 Claims, 13 Drawing Sheets

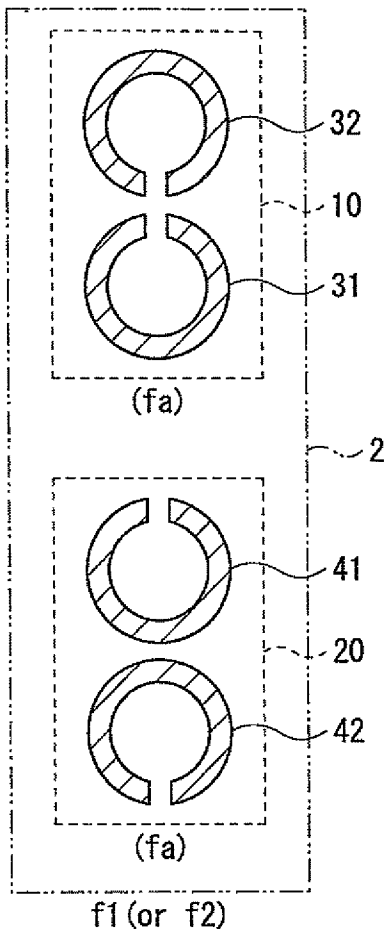
FIG. 4B
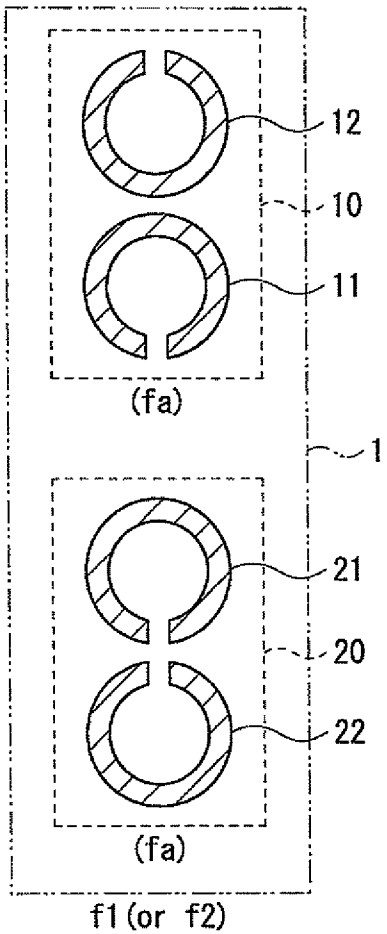
FIG. 4A
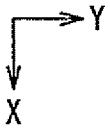

THICKNESS OF SUBSTRATE 0. 1mm
RELATIVE PERMITTIVITY 3. 85

SIGNAL TRANSMISSION DEVICE, FILTER, AND INTER-SUBSTRATE COMMUNICATION DEVICE

BACKGROUND

The present disclosure relates to a signal transmission device, a filter, and an inter-substrate communication device for performing signal transmission with use of a plurality of substrates each having a resonator formed therein.

A signal transmission device for performing signal transmission with use of a plurality of substrates each having a resonator formed therein has been known. For example, Japanese Unexamined Patent Application Publication No. 2008-67012 discloses a configuration in which a resonator is constituted in each of different substrates, and the resonators are electromagnetically coupled to each other to constitute a two-stage filter for use in signal transmission.

SUMMARY

In the case of the structure in which resonators fowled in different substrates are electromagnetically coupled to each other, electric field and magnetic field are generated between the substrates. In this case, the existing structure causes a problem that, since coupling coefficient and resonance frequency between the resonators significantly change in response to a variation in the thickness of a layer of air present between substrates, center frequency and bandwidth of the device serving as a filter significantly vary.

It is desirable to provide a signal transmission device, a filter, and an inter-substrate communication device, which make it possible to suppress a variation in pass frequency and pass band due to a variation in the inter-substrate distance and realize a stable operation.

According to an embodiment of the present disclosure, there is provided a signal transmission device including: a first and a second substrates disposed facing each other in a first direction with a space therebetween; a first resonator including a plurality of first open-ended resonators and a single or a plurality of second open-ended resonators, the plurality of first open-ended resonators being formed in a first region of the first substrate, and being electromagnetically coupled to each other in the first direction, and the single or the plurality of second open-ended resonators being formed in a region of the second substrate corresponding to the first region, and being electromagnetically coupled to each other in the first direction; and a second resonator electromagnetically coupled to the first resonator, the second resonator performing signal transmission between the first resonator and the second resonator through the electromagnetic coupling therebetween. The plurality of first open-ended resonators include a first first-open-ended resonator and a second first-open-ended resonator, open ends of the first first-open-ended resonator facing a central portion of the second first-open-ended resonator, a central portion of the first first-open-ended resonator facing open ends of the second first-open-ended resonator. When the plurality of second open-ended resonators are employed, the plurality of second open-ended resonators include a first second-open-ended resonator and a second second-open-ended resonator, open ends of the first second-open-ended resonator facing a central portion of the second second-open-ended resonator, a central portion of the first second-open-ended resonator facing open ends of the second second-open-ended resonator. The first open-ended resonator and the second open-ended resonator in closest proximity to each other in the first resonator are arranged such that the respective open ends thereof face each other and the respective central portions thereof face each other.

According to an embodiment of the present disclosure, there is provided a filter including: a first and a second substrates disposed facing each other in a first direction with a space therebetween; a first resonator including a plurality of first open-ended resonators and a single or a plurality of second open-ended resonators, the plurality of first open-ended resonators being formed in a first region of the first substrate, and being electromagnetically coupled to each other in the first direction, and the single or the plurality of second open-ended resonators being formed in a region of the second substrate corresponding to the first region, and being electromagnetically coupled to each other in the first direction; and a second resonator electromagnetically coupled to the first resonator, the second resonator performing signal transmission between the first resonator and the second resonator through the electromagnetic coupling therebetween. The plurality of first open-ended resonators include a first first-open-ended resonator and a second first-open-ended resonator, open ends of the first first-open-ended resonator facing a central portion of the second first-open-ended resonator, a central portion of the first first-open-ended resonator facing open ends of the second first-open-ended resonator. When the plurality of second open-ended resonators are employed, the plurality of second open-ended resonators include a first second-open-ended resonator and a second second-open-ended resonator, open ends of the first second-open-ended resonator facing a central portion of the second second-open-ended resonator, a central portion of the first second-open-ended resonator facing open ends of the second second-open-ended resonator. The first open-ended resonator and the second open-ended resonator in closest proximity to each other in the first resonator are arranged such that the respective open ends thereof face each other and the respective central portions thereof face each other.

Advantageously, in the signal transmission device and the filter of the embodiments of the present disclosure, the second resonator includes a plurality of third open-ended resonators and a single or a plurality of fourth open-ended resonators, the plurality of third open-ended resonators being formed in a second region of the first substrate, and being electromagnetically coupled to each other in the first direction, and the single or the plurality of fourth open-ended resonators being formed in a region of the second substrate corresponding to the second region, and being electromagnetically coupled to each other in the first direction. The third open-ended resonators include a first third-open-ended resonator and a second third-open-ended resonator, open ends of the first third-open-ended resonator facing a central portion of the second third-open-ended resonator, a central portion of the first third-open-ended resonator facing open ends of the second third-open-ended resonator. When the plurality of fourth open-ended resonators are employed, the plurality of fourth open-ended resonators include a first fourth-open-ended resonator and a second fourth-open-ended resonator, open ends of the first fourth-open-ended resonator facing a central portion of the second fourth-open-ended resonator, a central portion of the first fourth-open-ended resonator facing open ends of the second fourth-open-ended resonator. The third open-ended resonator and the fourth open-ended resonator in closest proximity to each other in the second resonator are arranged such that the respective open ends thereof face each other and the respective central portions thereof face each other.

According to an embodiment of the present disclosure, there is provided an inter-substrate communication device including: a first and a second substrates disposed facing each other in a first direction with a space therebetween; a first resonator including a plurality of first open-ended resonators and a single or a plurality of second open-ended resonators, the plurality of first open-ended resonators being formed in a first region of the first substrate, and being electromagnetically coupled to each other in the first direction, and the single or the plurality of second open-ended resonators being formed in a region of the second substrate corresponding to the first region, and being electromagnetically coupled to each other in the first direction; a second resonator including a plurality of third open-ended resonators and a single or a plurality of fourth open-ended resonators, the plurality of third open-ended resonators being formed in a second region of the first substrate, and being electromagnetically coupled to each other in the first direction, and the single or the plurality of fourth open-ended resonators being formed in a region of the second substrate corresponding to the second region, and being electromagnetically coupled to each other in the first direction, and the second resonator being electromagnetically coupled to the first resonator to perform signal transmission between the first resonator and the second resonator; a first signal-lead electrode formed in the first substrate, the first signal-lead electrode being physically and directly connected to one of the plurality of first open-ended resonators, or being electromagnetically coupled to one of the plurality of first open-ended resonators while providing a spacing between the first signal-lead electrode and the first open-ended resonator; and a second signal-lead electrode formed in the second substrate, the second signal-lead electrode being physically and directly connected to one of the plurality of fourth open-ended resonators, or being electromagnetically coupled to one of the plurality of the fourth open-ended resonators while providing a spacing between the second signal-lead electrode and the fourth open-ended resonator. The plurality of first open-ended resonators include a first first-open-ended resonator and a second first-open-ended resonator, open ends of the first first-open-ended resonator facing a central portion of the second first-open-ended resonator, a central portion of the first first-open-ended resonator facing open ends of the second first-open-ended resonator. When the plurality of second open-ended resonators are employed, the plurality of second open-ended resonators include a first second-open-ended resonator and a second second-open-ended resonator, open ends of the first second-open-ended resonator facing a central portion of the second second-open-ended resonator, a central portion of the first second-open-ended resonator facing open ends of the second second-open-ended resonator. The plurality of third open-ended resonators include a first third-open-ended resonator and a second third-open-ended resonator, open ends of the first third-open-ended resonator facing a central portion of the second third-open-ended resonator, a central portion of the first third-open-ended resonator facing open ends of the second third-open-ended resonator. When the plurality of fourth open-ended resonators are employed, the plurality of fourth open-ended resonators include a first fourth-open-ended resonator and a second fourth-open-ended resonator, open ends of the first fourth-open-ended resonator facing a central portion of the second fourth-open-ended resonator, a central portion of the first fourth-open-ended resonator facing open ends of the second fourth-open-ended resonator. The first open-ended resonator and the second open-ended resonator in closest proximity to each other in the first resonator are arranged such that the respective open ends thereof face each other and the respective central portions thereof face each other. The third open-ended resonator and the fourth open-ended resonator in closest proximity to each other in the second resonator are arranged such that the respective open ends thereof face each other and the respective central portions thereof face each other. The inter-substrate communication device performs signal transmission between the first substrate and the second substrate.

According to the signal transmission device, the filter, and the inter-substrate communication device according to the embodiments of the present disclosure, since the first open-ended resonator and the second open-ended resonator in closest proximity to each other between the first substrate and the second substrate are arranged such that the respective open ends thereof face each other and the respective central portions thereof face each other, the two open-ended resonators have the same current direction, and potential difference between the two open-ended resonators is substantially zero. Thus, in the first resonator, electric field distribution in the air layer or the like between the first substrate and the second substrate is substantially uniform, and even when there is a variation in the inter-substrate distance such as the air layer or the like between the first substrate and the second substrate, it is possible to suppress a variation in resonance frequency in the first resonator. Likewise, since the third open-ended resonator and the fourth open-ended resonator in closest proximity to each other between the first substrate and the second substrate are arranged such that the respective open ends thereof face each other and the respective central portions thereof face each other, electric field distribution in the air layer or the like between the first substrate and the second substrate is substantially uniform in the second resonator, and therefore, even when there is a variation in the inter-substrate distance such as the air layer or the like between the first substrate and the second substrate, it is possible to suppress a variation in resonance frequency in the second resonator. As a result, it is possible to suppress a variation in pass frequency and pass band due to a variation in the inter-substrate distance.

In the signal transmission device, the filter, and the inter-substrate communication device according to the embodiments of the present disclosure, it is possible that when the plurality of first open-ended resonators and the single or plurality of second open-ended resonators are electromagnetically coupled to each other in a hybrid resonance mode, the first resonator acts as a coupled resonator collectively resonating at a first resonance frequency, and when the first and the second substrates are spaced from each other to fail to be electromagnetically coupled to each other, each of an independent resonance frequency of the plurality of first open-ended resonators and an independent resonance frequency of the plurality of second open-ended resonators is different from the first resonance frequency. Likewise, it is possible that when the plurality of third open-ended resonators and the single or the plurality of fourth open-ended resonators are electromagnetically coupled to each other in the hybrid resonance mode, the second resonator acts as a coupled resonator collectively resonating at the first resonance frequency, and when the first and the second substrates are spaced from each other to fail to be electromagnetically coupled to each other, each of an independent resonance frequency of the plurality of third open-ended resonators and an independent resonance frequency of the plurality of fourth open-ended resonators is different from the first resonance frequency.

In this configuration, the frequency characteristic in the state where the first substrate and the second substrate are separated from each other to fail to be electromagnetically coupled to each other and the frequency characteristic in the case where the first substrate and the second substrate are electromagnetically coupled to each other are different from each other. Therefore, in the state where the first substrate and the second substrate are electromagnetically coupled to each other, a signal is transmitted at the first resonance frequency, for example. On the other hand, in the state where the first substrate and the second substrate are separated from each other to fail to be electromagnetically coupled to each other, a signal is not transmitted at the first resonance frequency. Thus, in the state where the first substrate and the second substrate are separated from each other, it is possible to prevent a signal from being leaked.

The signal transmission device and the filter according to the embodiments of the present disclosure each may further include a first signal-lead electrode formed in the first substrate, the first signal-lead electrode and the first open-ended resonator being physically and directly connected to each other, or the first signal-lead electrode and the first resonator being electromagnetically coupled to each other with a space therebetween; and a second signal-lead electrode formed in the second substrate, the second signal-lead electrode and the fourth open-ended resonator being physically and directly connected to each other, or the second signal-lead electrode and the second resonator being electromagnetically coupled to each other with a space therebetween, and perform signal transmission between the first substrate and the second substrate.

The signal transmission device and the filter according to the embodiments of the present disclosure each may further include a first signal-lead electrode formed in the second substrate, the first signal-lead electrode and the second open-ended resonator being physically and directly connected to each other, or the first signal-lead electrode and the first resonator being electromagnetically coupled to each other with a space therebetween; and a second signal-lead electrode formed in the second substrate, the second signal-lead electrode and the fourth open-ended resonator being physically and directly connected to each other, or the second signal-lead electrode and the second resonator being electromagnetically coupled to each other with a space therebetween, and perform signal transmission in the second substrate.

According to the signal transmission device, the filter, and the inter-substrate communication device of the embodiments of the present disclosure, since the two open-ended resonators in closest proximity to each other between the first substrate and the second substrate are arranged such that the respective open ends thereof face each other and the respective central portions thereof face each other, electric field distribution in the air layer or the like between the first substrate and the second substrate is substantially uniform in the first and second resonators. Consequently, even when there is a variation in the inter-substrate distance such as the air layer or the like between the first substrate and the second substrate, it is possible to suppress a variation in resonance frequency in the first and second resonators. As a result, it is possible to suppress a variation in pass frequency and pass band due to a variation in the inter-substrate distance.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

FIG. 4A is a plan view illustrating a structure of the first resonator of the signal transmission device shown in FIG. 1 and resonance frequency thereof; and FIG. 4B is a plan view illustrating a structure of the second resonator of the signal transmission device shown in FIG. 1 and resonance frequency thereof.

DETAILED DESCRIPTION

Now, embodiments of the present disclosure will be described in detail with reference to the drawings.

[First Embodiment]

[Exemplary Configuration of Signal Transmission Device]

Figure 1:
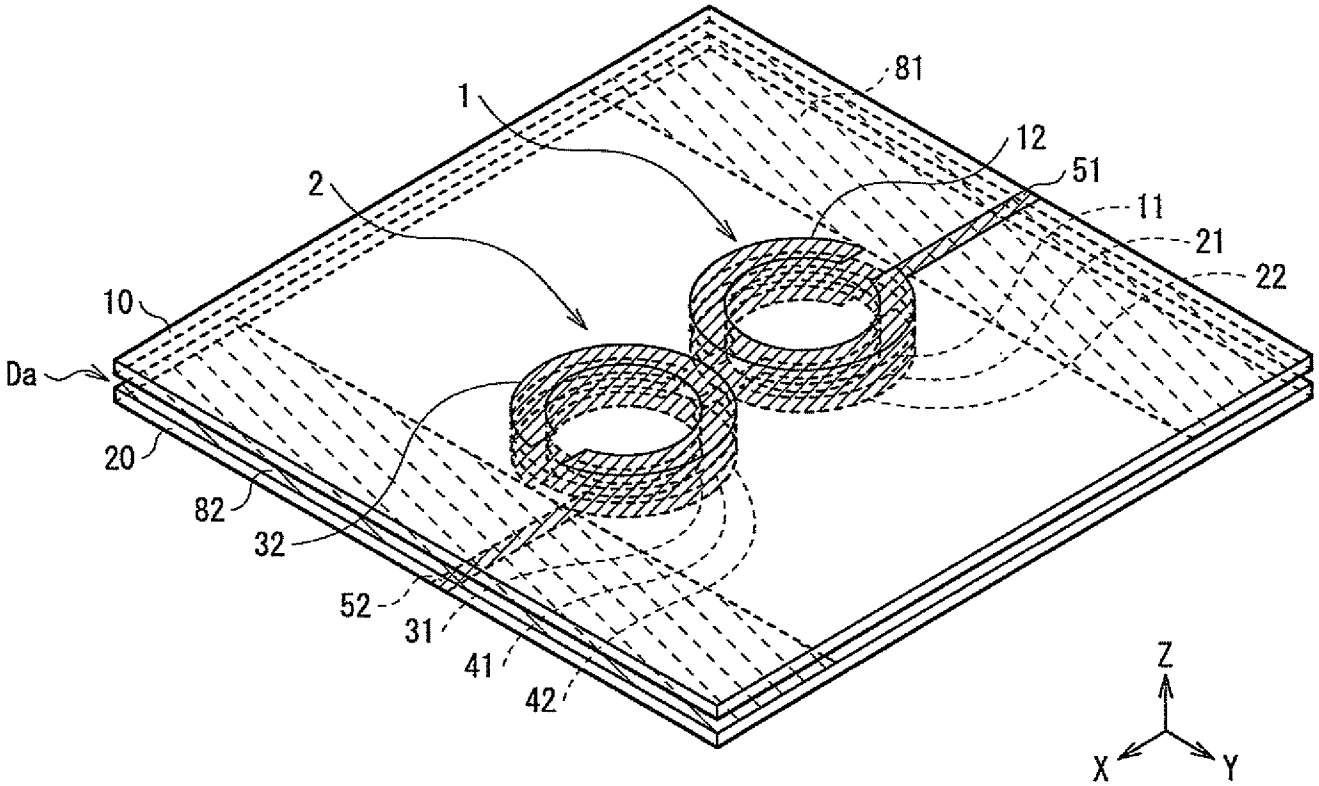
FIG. 1 is a perspective view illustrating an exemplary configuration of a signal transmission device (a filter, an inter-substrate communication device) according to an embodiment of the present disclosure.

FIG. 1 is an exemplary general configuration of a signal transmission device (a filter, an inter-substrate communication device) according to a first embodiment of the present disclosure. The signal transmission device according to the first embodiment includes a first substrate 10 and a second substrate 20 disposed facing each other in the first direction (Z direction in FIG. 1). The first substrate 10 and the second substrate 20 are dielectric substrates, and disposed facing each other with a space (inter-substrate distance Da), sandwiching therebetween a layer made of different material from the substrate material (a layer having different permittivity such as air layer). A first resonator 1 and a second resonator 2 are formed in the first substrate 10 and the second substrate 20. The second resonator 2 is arranged in parallel with the first resonator 1 in the second direction (X direction in FIG. 1), and is electromagnetically coupled to the first resonator 1 to carry out signal transmission with the first resonator 1. The first resonator 1 has first open-ended resonators 11 and 12 formed in the first substrate 10, and second open-ended resonators 21 and 22 formed in the second substrate 20. The second resonator 2 has third open-ended resonators 31 and 32 formed in the first substrate 10, and fourth open-ended resonators 41 and 42 formed in the second substrate 20.

The signal transmission device includes a first signal-lead electrode 51 formed in the first substrate 10, and a second signal-lead electrode 52 formed in the second substrate 20. The first open-ended resonators 11 and 12, the third open-ended resonators 31 and 32, and the first signal-lead electrode 51 formed in the first substrate 10 are each a conductor and an electrode pattern. Likewise, the second open-ended resonators 21 and 22, the fourth open-ended resonators 41 and 42, and the second signal-lead electrode 52 formed on the second substrate 20 are each a conductor and an electrode pattern. It is to be noted that, in FIG. 1, the illustration of the thickness of the electrode patterns (the first open-ended resonators 11 and 12 and so forth) formed in the first substrate 10 and the second substrate 20 is skipped. The first signal-lead electrode 51 is formed on the front (upper surface) of the first substrate 10. A ground electrode 81 is formed at a position facing the first signal-lead electrode 51 on the back (bottom surface) of the first substrate 10. The second signal-lead electrode 52 is formed on the back (bottom surface) of the second substrate 20. A ground electrode 82 is formed at a position facing the second signal-lead electrode 52 on the front (upper surface) of the second substrate 20.

FIGS. 2A to 2D are plan views illustrating a configuration of the first open-ended resonators 11 and 12 and the second open-ended resonators 21 and 22 constituting the first resonator 1 and current vectors at the time of resonance. FIG. 3 illustrates a structure of the second open-ended resonators 21 and 22 formed in the second substrate 20. FIGS. 4A and 4B illustrate the structure of the first resonator 1 and the second resonator 2 and resonance frequency in each section of the substrates.

Each of the first open-ended resonators 11 and 12, the second open-ended resonators 21 and 22, the third open-ended resonators 31 and 32, and the fourth open-ended resonators 41 and 42 is a half wavelength resonator having a closed curve shape, or so-called open-ring resonator.

In a first region of the first substrate 10, the first open-ended resonators 11 and 12 are electromagnetically coupled to each other in the first direction (Z direction in the figure). The first open-ended resonator 11 is formed on the back of the first substrate 10. The first open-ended resonator 12 is formed on the front of the first substrate 10. In a region corresponding to the first region of the second substrate 20, the second open-ended resonators 21 and 22 are electromagnetically coupled to each other in the first direction. Thus, the first resonator 1 having a structure in which the first open-ended resonators 11 and 12 and the second open-ended resonators 21 and 22 are stacked in the first direction is formed in the first region.

Figure 2:
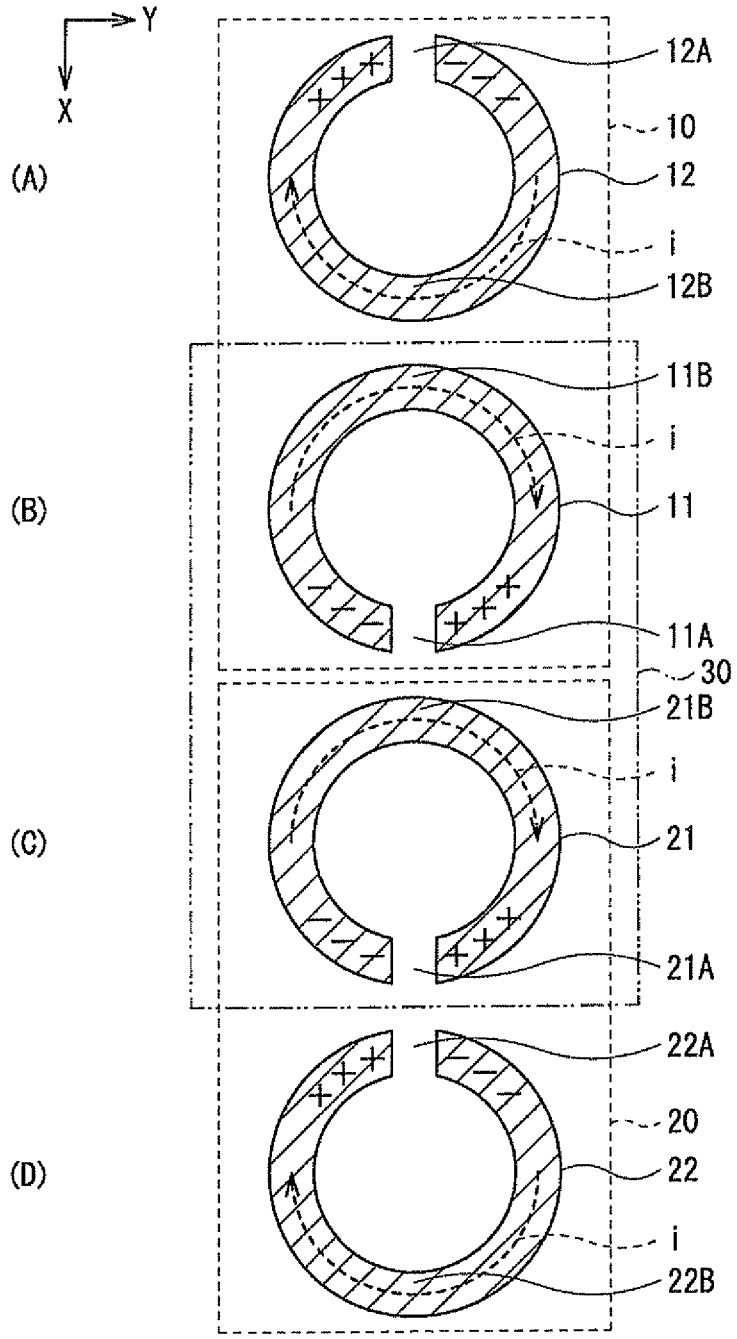
FIG. 2A is a plan view illustrating a structure of a first open-ended resonator formed on the front of a first substrate of the signal transmission device shown in FIG. 1 and current vector at the time of resonance.
FIG. 2B is a plan view illustrating a structure of a first open-ended resonator formed on the back of the first substrate and current vector at the time of resonance.
FIG. 2C is a plan view illustrating a structure of a second open-ended resonator formed on the front of a second substrate of the signal transmission device shown in FIG. 1 and current vector at the time of resonance.
FIG. 2D is a plan view illustrating a structure of a second open-ended resonator formed on the back of the second substrate and current vector at the time of resonance.
Figure 3:
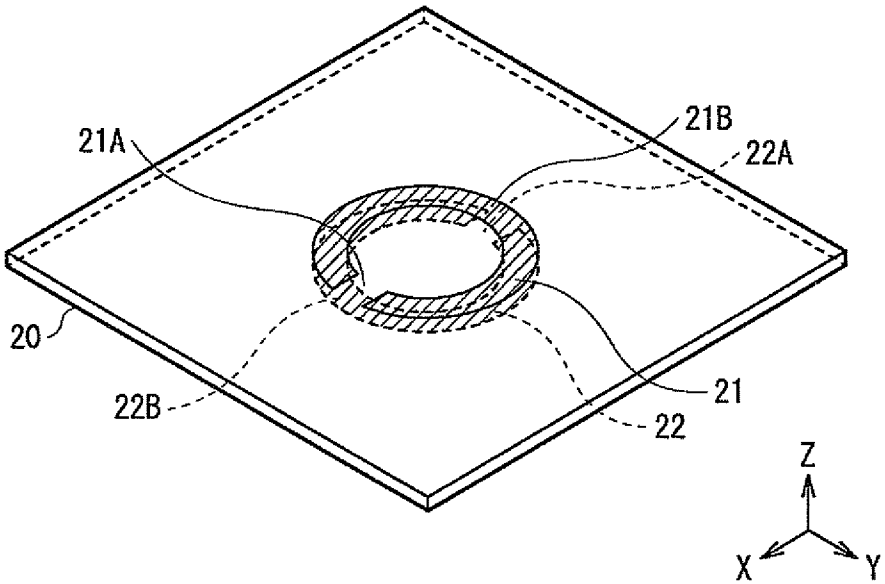
FIG. 3 is a perspective view illustrating an arrangement of the second open-ended resonators formed in the second substrate of the signal transmission device shown in FIG. 1.

The first open-ended resonator 11 and the second open-ended resonator 21 in closest proximity to each other (opposing portions 30 of the substrates) in the first resonator 1 are arranged such that open-ended portions 11A and 21A thereof are facing each other, and that central portions 11B and 21B thereof are facing each other (see FIGS. 2B and 2C). The first open-ended resonators 11 and 12 are arranged such that the open-ended portion 11A of the first open-ended resonator 11 faces the central portion 12B of the first open-ended resonator 12, and that the central portion 1113 of the first open-ended resonator 11 faces the open-ended portion 12A of the first open-ended resonator 12 (see FIGS. 2A and 2B). The second open-ended resonators 21 and 22 are arranged such that the open-ended portion 21A of the second open-ended resonator 21 faces a central portion 22B of the second open-ended resonator 22, and that the central portion 21B of the second open-ended resonator 21 faces an open-ended portion 22A of the second open-ended resonator 22 (see FIGS. 2C and 2D and FIG. 3). In this case, the center of the open-ended resonator is a position where electrical length ranging from the center to the first end of the open-ended resonator and electrical length ranging from the center to the second end of the open-ended resonator are equal. For example, in the case where the open-ended resonator is made of a single material and is uniformly formed, the center of the open-ended resonator is a position where physical length ranging from the center to the first end of the open-ended resonator and physical length ranging from the center to the second end of the open-ended resonator are equal. In addition, the central portion of the open-ended resonator is a region including the center of the open-ended resonator, and, is a range, from the center of the open-ended resonator to both open-end portions thereof, including a portion of $\lambda/16$ in electrical length, for example.

In a second region of the first substrate 10, the third open-ended resonators 31 and 32 are electromagnetically coupled to each other in the first direction (Z direction in the figure). The third open-ended resonator 31 is formed on the back of the first substrate 10. The third open-ended resonator 32 is formed on the front of the first substrate 10. In a region corresponding to the second region of the second substrate 20, the fourth open-ended resonators 41 and 42 are electromagnetically coupled to each other in the first direction. Thus, the second resonator 2 having a structure in which the third open-ended resonators 31 and 32 and the fourth open-ended resonators 41 and 42 are stacked in the first direction is formed in the second region separated from the first region.

The positional relationship between the two adjacent open-ended resonators in the second resonator 2 is the same as that of the first resonator 1. To be more specific, the third open-ended resonator 31 and the fourth open-ended resonator 41 in closest proximity to each other (opposing portions of the substrates) in the second resonator 2 are arranged such that open-ended portions thereof are facing each other, and that central portions thereof are facing each other. The third open-ended resonators 31 and 32 are arranged such that the open-ended portion of the third open-ended resonator 31 faces the central portion of the third open-ended resonator 32, and that the central portion of the third open-ended resonator 31 faces the open-ended portion of the third open-ended resonator 32. The fourth open-ended resonators 41 and 42 are arranged such that the open-ended portion of the fourth open-ended resonator 41 faces the central portion of the fourth open-ended resonator 42, and that the central portion of the fourth open-ended resonator 41 faces the open-ended portion of the fourth open-ended resonator 42.

Referring to FIG. 1, the first signal-lead electrode 51 is formed on the front of the first substrate 10, and physically and directly connected to the first open-ended resonator 12 disposed on the front of the first substrate 10 (for example, directly connect to one of the open ends) in order to be electrically and directly connected to the first open-ended resonator 12. Consequently, it is possible to realize signal transmission between the first signal-lead electrode 51 and the first resonator 1. Referring to FIG. 1, the second signal-lead electrode 52 is formed on the back of the second substrate 20, and physically and directly connected to the fourth open-ended resonator 42 disposed on the back of the second substrate 20 (for example, directly connect to one of the open ends) in order to be electrically and directly connected to the fourth open-ended resonator 42. Consequently, it is possible to realize signal transmission between the second signal-lead electrode 52 and the second resonator 2. Since the first resonator 1 and the second resonator 2 are electromagnetically coupled to each other, it is possible to realize signal transmission between the first signal-lead electrode 51 and the second signal-lead electrode 52. Thus, signal transmission between two substrates, the first substrate 10 and the second substrate 20, is realized.

It is to be noted that, a configuration may be adopted in which the first signal-lead electrode 51 is formed on the back of the first substrate 10, and the first signal-lead electrode 51 thus formed is physically and directly connected to the first open-ended resonator 11 disposed on the back of the first substrate 10 in order to be directly and electrically connected to the first open-ended resonator 11. Likewise, a configuration may be adopted in which the second signal-lead electrode 52 is formed on the front of the second substrate 20, and physically and directly connected to the fourth open-ended resonator 41 disposed on the front of the second substrate 20 in order to be directly and electrically connected to the fourth open-ended resonator 41.

[Operation and Function]

In the first resonator 1 of the signal transmission device, the first open-ended resonator 11 and the second open-ended resonator 21 in closest proximity to each other between the first substrate 10 and the second substrate 20 are disposed such that the open-ended portions 11A and 21A thereof face each other, and that the central portions 11B and 21B thereof face each other. In this state, as shown in FIGS. 2B and 2C, since current i flows through the first open-ended resonator 11 and the second open-ended resonator 21 in the same direction, potential difference between the open-ended resonators 11 and 21 is substantially zero. That is, the first open-ended resonator 11 and the second open-ended resonator 21 have the same potential as each other, and therefore, no electric field is generated between the resonators. The first open-ended resonator 11 and the second open-ended resonator 21 are coupled almost exclusively by magnetic coupling. Thus, in the first resonator 1, electric field distribution is substantially uniform in the air layer between the first substrate 10 and the second substrate 20 and the like, and even if there is a variation in an inter-substrate distance Da such as an air layer between the first substrate 10 and the second substrate 20, it is possible to suppress a variation in resonance frequency in the first resonator 1.

Similarly, in the second resonator 2, the third open-ended resonator 31 and the fourth open-ended resonator 41 in closest proximity to each other between the first substrate 10 and the second substrate 20 are disposed such that the open-ended portions thereof face each other, and that the central portions thereof face each other. Thus, in the second resonator 2, electric field distribution is substantially uniform in the air layer or the like between the first substrate 10 and the second substrate 20, and the third open-ended resonator 31 and the fourth open-ended resonator 41 are coupled almost exclusively by magnetic coupling. Consequently, even if there is a variation in the inter-substrate distance Da such as an air layer between the first substrate 10 and the second substrate 20, it is possible to suppress a variation in resonance frequency in the second resonator 2. As a result, it is possible to suppress a variation in pass frequency and pass band due to a variation in the inter-substrate distance Da.

Additionally, in the signal transmission device, as shown in FIG. 4A, when the first pair of open-ended resonators 11 and 12 and the second pair of open-ended resonators 21 and 22 are electromagnetically coupled to each other in a hybrid resonance mode described later, the first resonator 1 acts as a coupled resonator which collectively resonates at the first resonance frequency f1 (or the second resonance frequency f2). On the other hand, in a state where the first substrate 10 and the second substrate 20 are sufficiently separated from each other so as not to be or fail to be electromagnetically coupled to each other, the first pair of open-ended resonators 11 and 12 independently resonates at the resonance frequency fa, and the second pair of open-ended resonators 21 and 22 independently resonates at the resonance frequency fa. In this case, the resonance frequency fa and the first resonance frequency f1 (or the second resonance frequency f2) are different frequencies from each other.

Likewise, as shown in FIG. 4B, when the third pair of open-ended resonators 31 and 32 and the fourth pair of open-ended resonators 41 and 42 are electromagnetically coupled to each other in the hybrid resonance mode, the second resonator 2 acts as a coupled resonator which collectively resonates at the first resonance frequency f1 (or the second resonance frequency f2). On the other hand, in a state where the first substrate 10 and the second substrate 20 are sufficiently separated from each other so as not to be electromagnetically coupled to each other, the third pair of open-ended resonators 31 and 32 independently resonates at the resonance frequency fa, and the fourth pair of open-ended resonators 41 and 42 independently resonates at the resonance frequency fa. In this case, the resonance frequency fa and the first resonance frequency f1 (or the second resonance frequency f2) are different frequencies from each other.

Therefore, the frequency characteristic in a state where the first substrate 10 and the second substrate 20 are sufficiently separated from each other so as not to be electromagnetically coupled to each other and the frequency characteristic in the case where the first substrate 10 and the second substrate 20 are electromagnetically coupled to each other are different from each other. Therefore, in a state where the first substrate 10 and the second substrate 20 are electromagnetically coupled to each other, a signal is transmitted at the first resonance frequency f1 (or the second resonance frequency f2), for example. On the other hand, in a state where the first substrate 10 and the second substrate 20 are sufficiently separated from each other so as not to be electromagnetically coupled to each other, resonance occurs at the resonance frequency fa, so that a signal is not transmitted at the first resonance frequency f1 (or the second resonance frequency f2). Thus, in a state where the first substrate 10 and the second substrate 20 are sufficiently separated from each other, a signal having the first resonance frequency f1 (or the second resonance frequency f2) is reflected, whereby a signal is prevented from being leaked from the resonator.

[Principle of Signal Transmission in Hybrid Resonance Mode]

Figure 5:
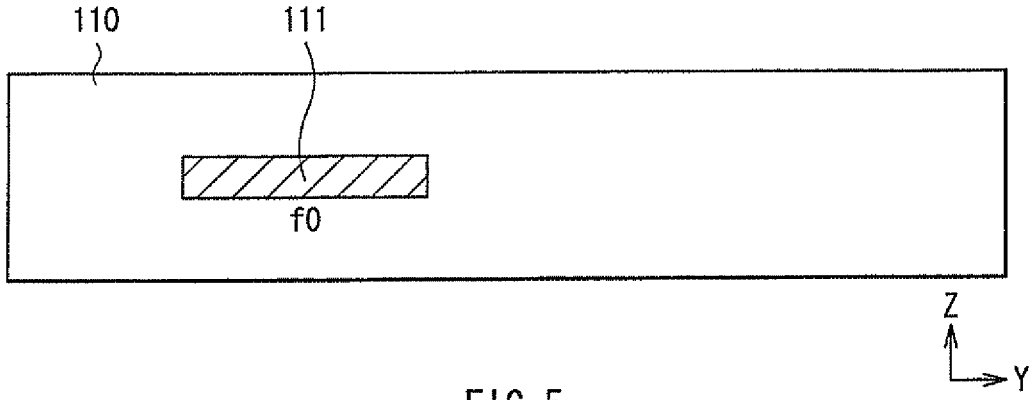
FIG. 5 RELATED ART
FIG. 5 is a sectional view illustrating a substrate having a resonator structure according to a comparative example.
Figure 6:
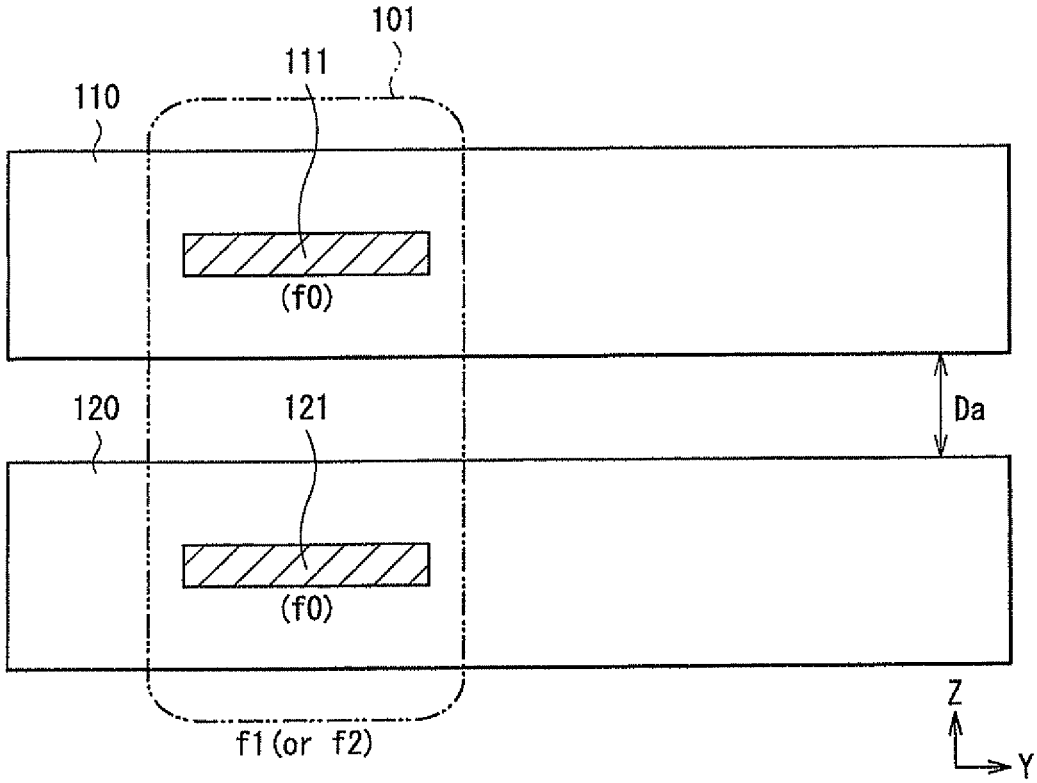
FIG. 6 is a sectional view illustrating a structure in which two substrates each having the same resonator structure as the substrate shown in FIG. 5 are disposed facing each other.
Figure 7:
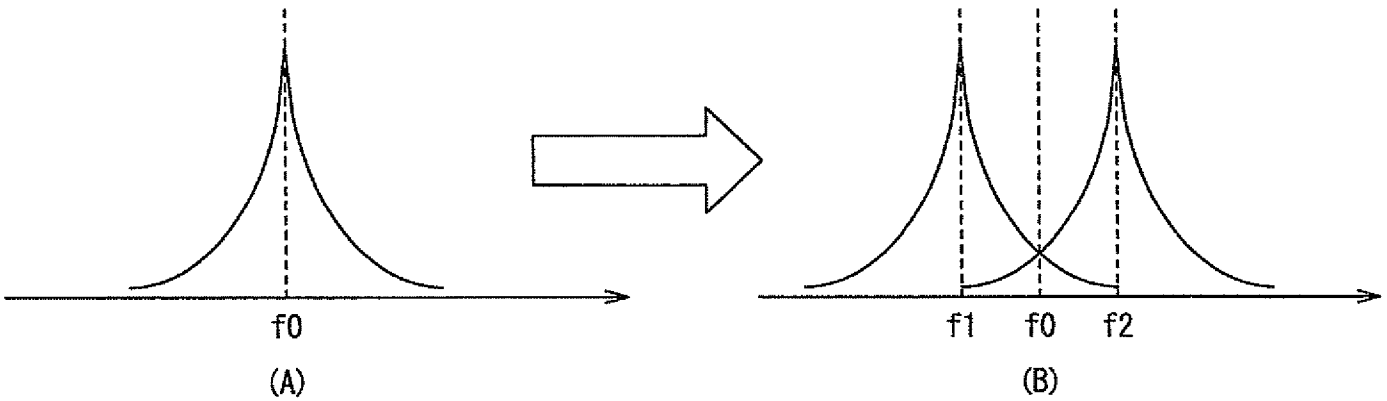
FIG. 7A is an explanatory view illustrating resonance frequency in the case of one resonator.
FIG. 7B is an explanatory view illustrating resonance frequency in the case of two resonators.

Now, the principle of the signal transmission in the above mentioned hybrid resonance mode is described. For the sake of simplicity, as a resonator structure of a comparative example, a configuration is considered in which a resonator 111 is formed in the first substrate 110 as shown in FIG. 5. The resonator structure of the comparative example establishes a resonance mode in which resonance occurs at the resonance frequency f0, as shown in FIG. 7A. Meanwhile, as shown in FIG. 6, a case is considered in which the second substrate 120 having a structure similar to the resonator structure of the comparative example shown in FIG. 5 is disposed facing the first substrate 110 with an inter-substrate distance Da therebetween in order to establish an electromagnetic coupling with the first substrate 110. A resonator 121 is formed in the second substrate 120. The structure of the resonator 121 in the second substrate 120 is the same as that of the resonator 111 in the first substrate 110. Therefore, in an independent state in which the second substrate 120 is not electromagnetically coupled to the first substrate 110, an independent resonance mode in which a resonance occurs at the resonance frequency f0 as shown in FIG. 7A. However, transition of radio wave occurs in a state in which the two resonators shown in FIG. 6 are electromagnetically coupled to each other, so that resonance does not occur at the resonance frequency f0 in the independent resonance mode. In this case, resonance occurs in two modes: a first resonance mode in which resonance occurs at the first resonance frequency f1 which is lower in frequency than the resonance frequency f0 in the independent resonance mode, and a second resonance mode in which resonance occurs at the second resonance frequency f2 which is higher in frequency than the resonance frequency f0 in the independent resonance mode.

Figure 8:
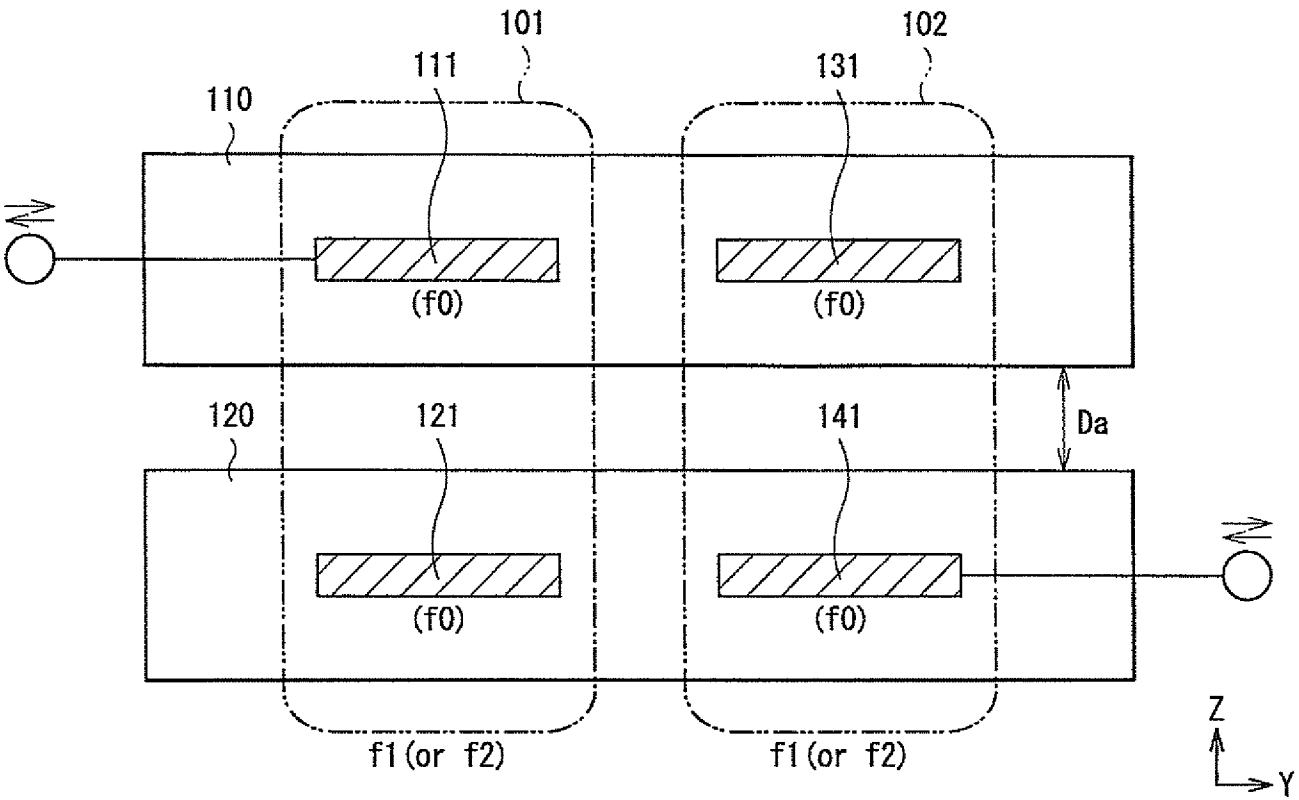
FIG. 8 is a sectional view illustrating a structure of a filter according to a comparative example formed with use of the resonator structure shown in FIG. 6, and resonance frequency of each section of the substrate.

When the two resonators 111 and 121 electromagnetically coupled in the hybrid resonance mode shown in FIG. 6 are considered as one coupled resonator 101, when a coupled resonator having the same resonator structure as the coupled resonator 101 is disposed in parallel to the coupled resonator 101, it is possible to constitute a filter in which the first resonance frequency f1 (or the second resonance frequency f2) corresponds to a pass band thereof. An example of such a configuration is illustrated in FIG. 8. In the filter configuration shown in FIG. 8, two resonators 111 and 131 are arranged in parallel to each other in the first substrate 110, and two resonators 121 and 141 are arranged in parallel to each other in the second substrate 120. In a state where the first substrate 110 and the second substrate 120 are sufficiently separated from each other so as not to be electromagnetically coupled to each other, each of the resonators 111 and 131 formed in the first substrate 110 and each of the resonators 121 and 141 formed in the second substrate 120 does not establish the hybrid resonance mode, but establishes a resonance mode in which resonance occurs independently at the resonance frequency f0. Meanwhile, in a state where the first substrate 110 and the second substrate 120 are disposed facing each other with the inter-substrate distance Da therebetween in order to be electromagnetically coupled to each other, the resonator 111 of the first substrate 110 and the resonator 121 of the second substrate 120 collectively constitute a coupled resonator 101. Likewise, the resonator 131 of the first substrate 110 and the resonator 141 of the second substrate 120 collectively constitute a coupled resonator 102. Each of the two coupled resonators 101 and 102 collectively resonates at the first resonance frequency f1 (or the second resonance frequency 12) to thereby operate as a filter having a pass band corresponding to the first resonance frequency f1 (or the second resonance frequency f2). Signal transmission is accomplished by inputting a signal having a frequency around the first resonance frequency f1 (or the second resonance frequency f2).

On the basis of the above described principle, the resonance mode of the signal transmission device according to the first embodiment will be described more in detail. As is the cases of the first open-ended resonators 11 and 12, the second open-ended resonators 21 and 22, the third open-ended resonators 31 and 32, the fourth open-ended resonators 41 and 42 shown in FIGS. 4A and 4B, in the case where resonators which are electromagnetically coupled such that the open end of one of the open-ended resonator faces the central portion of the other open-ended resonator, and that the central portion of one of the open-ended resonator faces the open end of the other open-ended resonator (in the following, a coupling established through such an arrangement of the open-ended resonators is referred to as "A coupling") are formed in the substrate, the open-ended resonators electromagnetically coupled to each other also resonate in the hybrid resonance mode. That is, for example, when the first open-ended resonators 11 and 12 are electromagnetically coupled to each other in the hybrid resonance mode, the resonators constitute a coupled resonator which resonates at the resonance frequency fa which is lower than the resonance frequency f0 in the independent resonance mode of the open-ended resonators 11 and 12 established in a state where the first open-ended resonators 11 and 12 are sufficiently separated from each other so as not to be electromagnetically coupled each other, and the resonance frequency fb which is higher than the resonance frequency f0. In the case where the first open-ended resonators 11 and 12 formed in the first substrate 10 and coupled to each other through the A coupling and the second open-ended resonators 21 and 22 formed in the second substrate 20 and coupled to each other through the A coupling are electromagnetically coupled to each other with an air layer or the like therebetween, as described above, since the hybrid resonance modes are electromagnetically coupled to each other, the first open-ended resonators 11 and 12 and the second open-ended resonators 21 and 22 become a coupled resonator having a plurality of resonance modes (the first resonator 1). The first resonator 1 has a plurality of resonance modes (resonance frequency f1, f2, . . . satisfying the following relationship: f1<f2< . . . ). Likewise, in the case where the third open-ended resonators 31 and 32 formed in the second substrate 20 and coupled to each other through the A coupling and the fourth open-ended resonators 41 and 42 formed in the second substrate 20 and coupled to each other through the A coupling are electromagnetically coupled to each other with an air layer or the like therebetween, as described above, since the hybrid resonance modes are electromagnetically coupled to each other, the third open-ended resonators 31 and 32 and the fourth open-ended resonators 41 and 42 become a coupled resonator having a plurality of resonance modes (the second resonator 2). The second resonator 2 has a plurality of resonance modes (resonance frequency f1, 2, . . . satisfying the following relationship: f1< f2< . . . ).

In this case, charge distribution and current vector i in the case of a resonance mode (resonance frequency f1) having the lowest resonance frequency among the resonance modes are shown in FIGS. 2A to 2D, and the open-ended resonators have the same current direction (clockwise direction as viewed from the top in FIGS. 2A to 2D). Accordingly, while the open-ended resonators coupled to each other through the A coupling are brought into an electromagnetically-coupled state, electric field distribution (electric field component) is substantially uniform in the space between the open-ended resonators in closest proximity between the first substrate 10 and the second substrate 20. Thus, for example, in a resonance mode having the lowest resonance frequency among the resonance modes, the open-ended resonators 11 and 21 in closest proximity between the first substrate 10 and the second substrate 20 have the same current direction (clockwise direction as viewed from the top in FIGS. 2A to 2D), and electric field distribution is substantially uniform in the space between the open-ended resonators, so that an electromagnetically-coupled state is established almost exclusively by magnetic field coupling.

In addition, since the A coupling is a strong coupling, it is possible to greatly enlarge the frequency difference between the first resonance frequency f1 and the second resonance frequency f2, and therefore, when the first resonator 1 and the second resonator 2 are arranged in parallel, it is possible to prevent a pass band including the first resonance frequency f1 of a plurality of resonance modes (resonance frequency f1, f2, . . . ) from overlapping in frequency with a pass band including the resonance frequency other than the first resonance frequency f1, that is, it is possible to differentiate the pass bands in terms of frequency. Further, the pass band including the first resonance frequency f1 and the pass band including the resonance frequency other than the first resonance frequency f1, in other words, each of the pass bands including resonance frequency of respective resonance modes (resonance frequency f1, f2, . . . ), are prevented from overlapping in frequency with the pass band including the resonance frequency fa obtained when the first substrate 10 or the second substrate 20 is in the independent resonance mode (passbands are differentiated in frequency). Therefore, the pass band including the first resonance frequency f1 is not appreciably affected not only by the other resonance modes, but also by the frequency around resonance frequency fa.

In conclusion, among the various resonance modes, it is preferable to set, as the pass band of the signal, the resonance frequency f1 in the resonance mode having the lowest frequency. It is to be noted that, even in the case of another resonance mode which provides a frequency higher than the resonance frequency f1, as long as the open-ended resonators in closest proximity to each other between the first substrate 10 and the second substrate 20 have the same current direction, it is possible to set the resonance frequency provided by the other resonance mode as the pass band of the signal.

[Specific Design Example and Characteristics]

Figure 9:
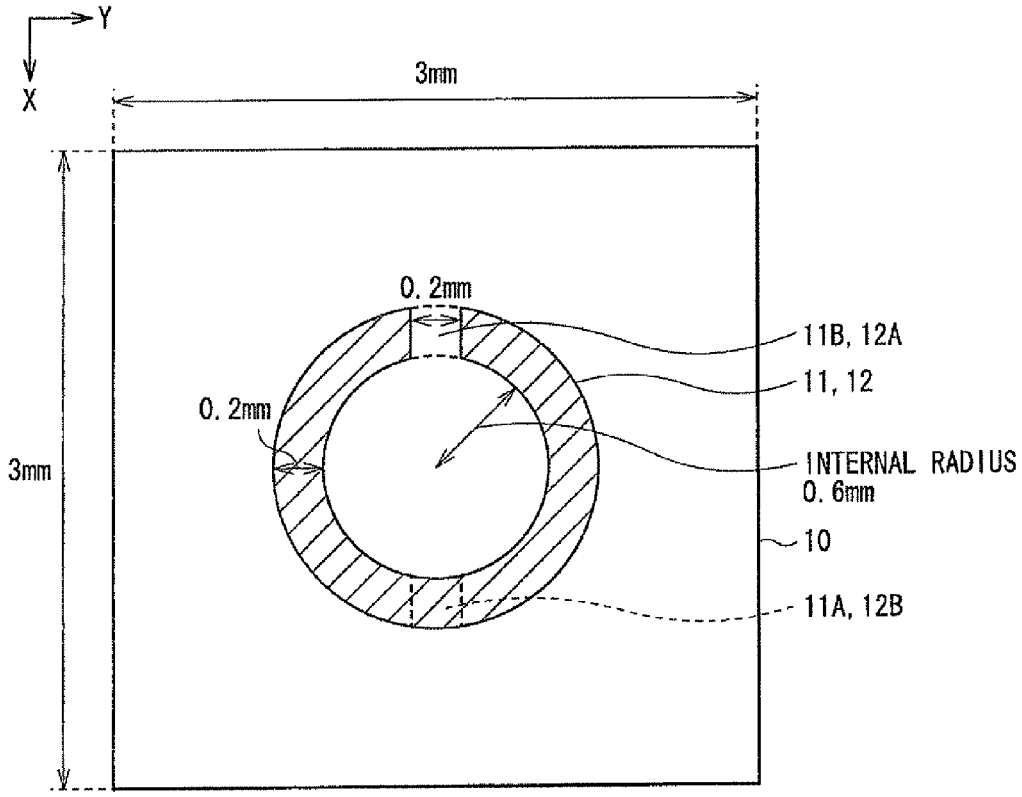
FIG. 9 is a plan view illustrating a specific design example of the first resonator of the signal transmission device shown in FIG. 1.
Figure 10:
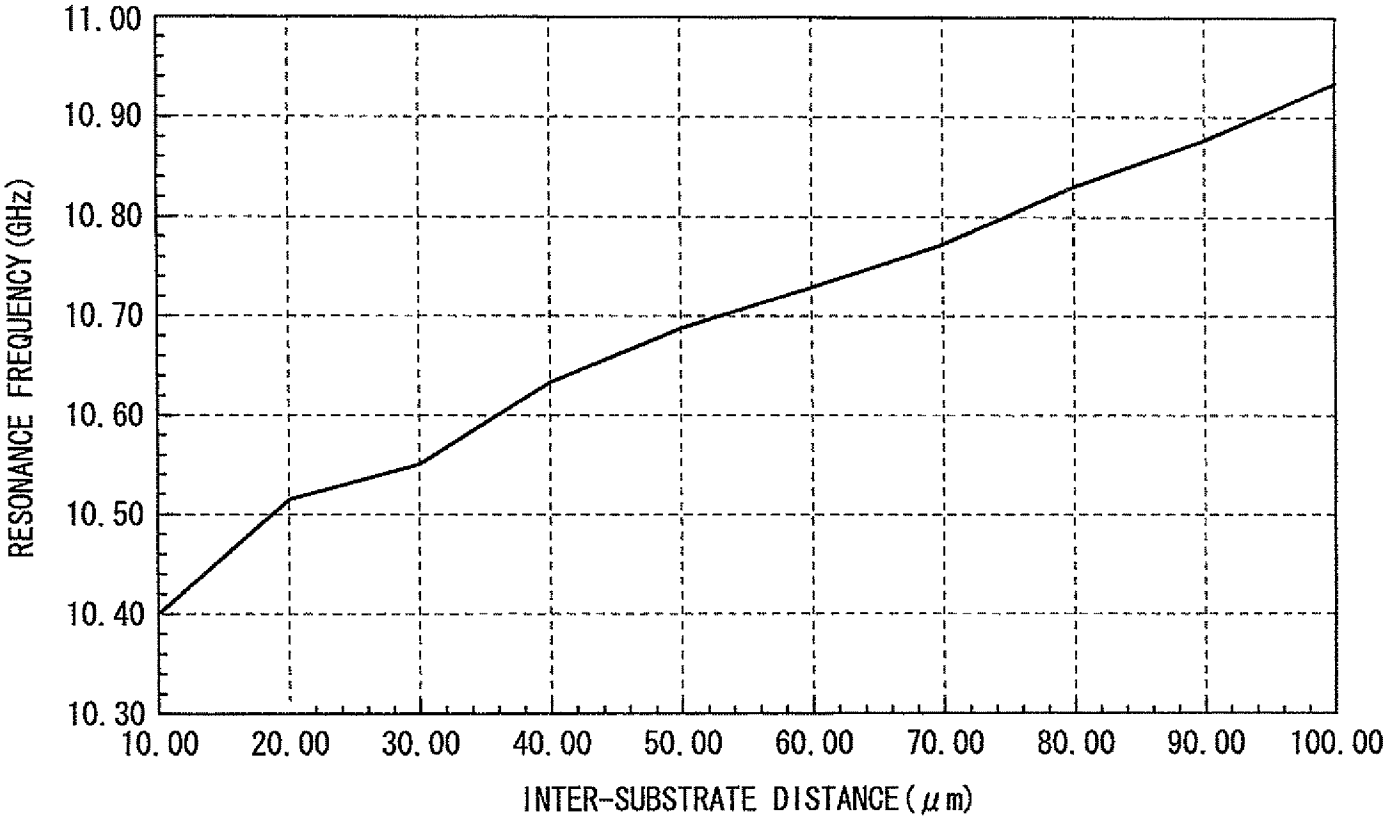
FIG. 10 is a characteristic graph illustrating resonance frequency characteristics of the first resonator shown in FIG. 9.

Next, specific design example and characteristics of the signal transmission device according to the first embodiment will be described in comparison to characteristics of a resonator structure of a comparative example. FIG. 9 illustrates a specific design example of the first resonator of the signal transmission device according to the first embodiment. FIG. 10 illustrates resonance frequency characteristics of the design example shown in FIG. 9. It is to be noted that while only the design example of the first substrate 10 is illustrated in FIG. 9, the second substrate 20 is designed in the same manner as the first substrate 10. In this design example, the plane size of each of the first substrate 10 and the second substrate 20 is 3 $mm^2$, the thickness of each of the substrates is 0.1 mm, and relative permittivity thereof is 3.85. The plane size of each electrode on the first substrate 10 (the first open-ended resonators 11 and 12) is such that the internal radius is 0.6 mm, and the width of the electrode (width of the line) is 0.2 mm. The size of each of the open-ended portions (the gap portion between the open ends of the open-ended resonator) 11A and 12A is 0.2 mm. The plane size of each electrodes on the second substrate 20 (the second open-ended resonators 21 and 22) is the same as in the case of the first substrate 10. In this configuration, the thickness (inter-substrate distance Da) of the air layer between substrates is changed in the range 10 μm to 100 μm to calculate resonance frequency, and the result of the calculation is shown in FIG. 10. As shown in FIG. 10, the resonator structure of the first embodiment shows only a slight variation in resonance frequency, and the variation in resonance frequency in response to the variation in the thickness of the air layer is only approximately 5% at a maximum.

Figure 11:
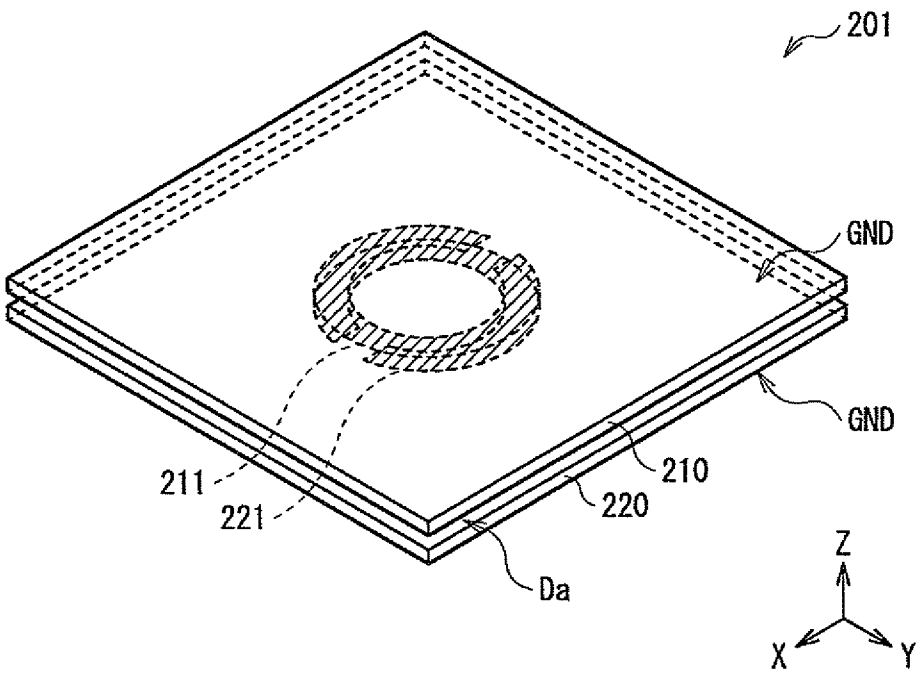
FIG. 11 RELATED ART
FIG. 11 is a perspective view illustrating a specific design example of resonator structure of a comparative example.
Figure 12:
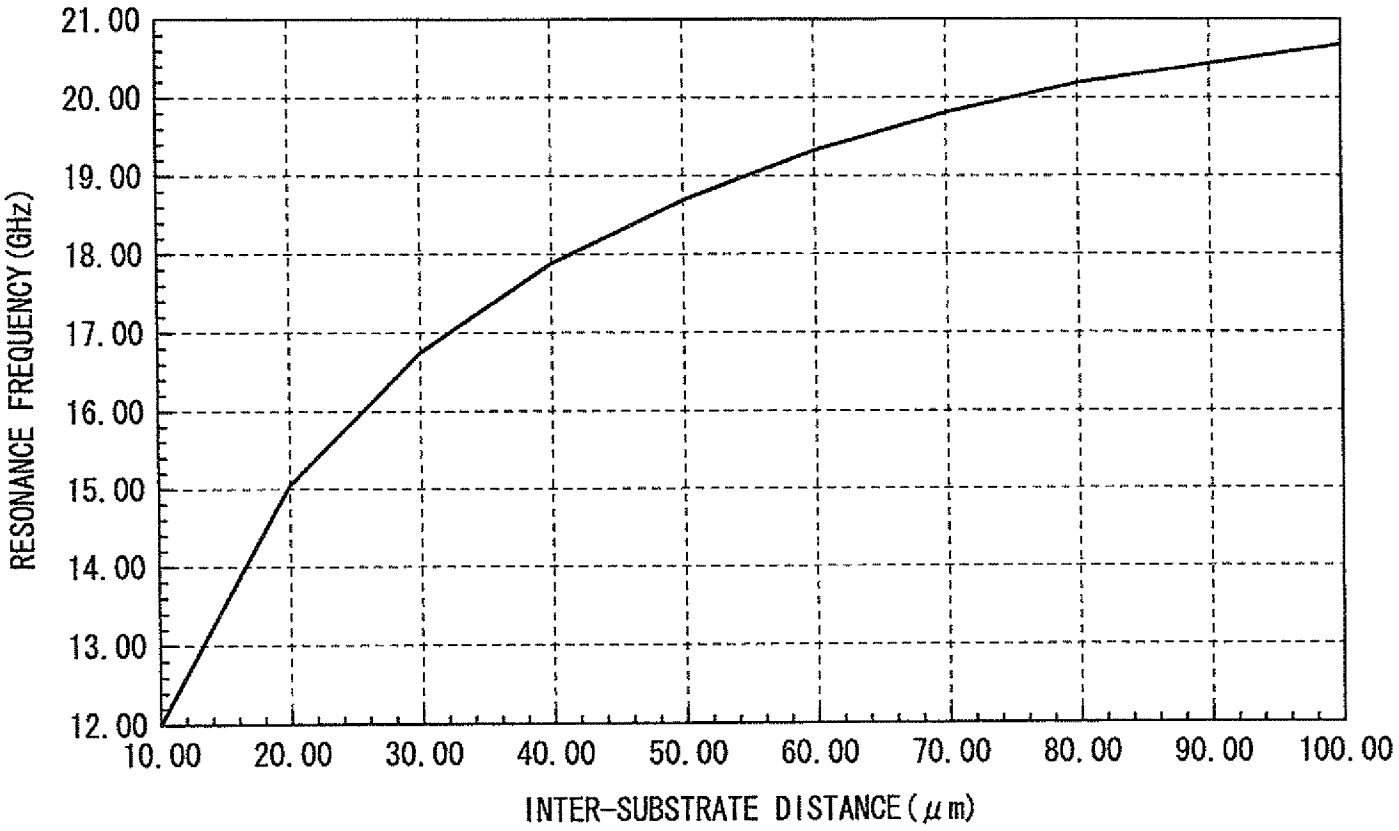
FIG. 12 RELATED ART
FIG. 12 is a characteristic graph illustrating resonance frequency characteristics of the resonator structure shown in FIG. 11.

FIG. 11 illustrates a specific design example of a resonator structure 201 of a comparative example. FIG. 12 illustrates resonance frequency characteristics of the resonator structure 201 shown in FIG. 11. The resonator structure 201 of the comparative example includes a first substrate 210 in which the front (upper surface) thereof is a ground electrode (ground surface GND), and a first open-ended resonator 211 is formed on the back (bottom surface) thereof, and a second substrate 220 in which the back (bottom surface) thereof is a ground electrode (ground surface GND), and a second open-ended resonator 221 is formed on the front (upper surface) thereof. The first substrate 210 and second substrate 220 are disposed facing each other with a space (inter-substrate distance Da), sandwiching an air layer therebetween. Between the two substrates, the first open-ended resonator 211 and the second open-ended resonator 221 are arranged such that each of open-ended portions thereof faces a central portion of the other side. The size of the substrates, electrodes, and the like of the resonator structure 201 of the comparative example is the same as in the case of the design example shown in FIG. 9. Specifically, the plane size of each of the first substrate 210 and the second substrate 220 is 3 $mm^2$, the thickness of each of the substrates is 0.1 mm, and relative permittivity thereof is 3.85. The plane size of each electrode on the two substrates (the first open-ended resonator 211 and the second open-ended resonator 221) is such that the internal radius is 0.6 mm, and the width of the electrode (width of line) is 0.2 mm. The size of each of the open-ended portions 11A and 12A is 0.2 mm. In this configuration, the thickness (inter-substrate distance Da) of the air layer between substrates is changed in the range 10 μm to 100 μm to calculate resonance frequency, and the result of the calculation is shown in FIG. 12. As shown in FIG. 12, the variation in resonance frequency of the resonator structure 201 of the comparative example in response to the variation in the thickness of the air layer is approximately 70% at a maximum. This is because effective relative permittivity between the first substrate 210 and the second substrate 220 varies in response to the variation in the thickness of the air layer.

[Effect]

According to the signal transmission device according to the first embodiment, since the two open-ended resonators in closest proximity to each other between the first substrate 10 and the second substrate 20 are arranged such that the open ends thereof face each other and the central portions thereof face each other, in the first resonator 1 and the second resonator 2, electric field distribution (electric field component) in the air layer or the like between the first substrate 10 and the second substrate 20 is substantially uniform. Consequently, even when there is a variation in the inter-substrate distance Da such as an air layer or the like between the first substrate 10 and the second substrate 20, it is possible to suppress a variation in resonance frequency in the first resonator 1 and the second resonator 2. As a result, it is possible to suppress a variation in pass frequency and pass band due to a variation in the inter-substrate distance Da.

Incidentally, increasing the volume of a resonator is one method for raising Q value of a resonator; however, it becomes difficult to realize miniaturization of components. For example, in the case where the first substrate 10 is a component of a resonator structure and the second substrate 20 is a mount substrate for mounting the component of the resonator structure, it is necessary for the existing resonator structure to increase the volume of the component in order to raise Q value of the resonator. On the other hand, in the case of the resonator structure of the first embodiment, it is possible to use an electrode pattern (the second open-ended resonator 21 and the like) of the mount substrate as a part of the resonator. Consequently, without increasing the volume of the component, it is possible to raise Q value of the resonator with use of the volume of the mount substrate as a part of the resonator. In addition, according to the resonator structure of the first embodiment, for example, it is possible to couple the component side (the first substrate 10) and the mount substrate (the second substrate 20) through the electromagnetic coupling without providing the component side (the first substrate 10) with a side terminal, so that it is possible to realize simplification of the configuration and cost reduction.

[Second Embodiment]

Next, a signal transmission device according to a second embodiment of the present disclosure will be described. It is to be noted that, the same reference numerals are given to the same components as those of the first embodiment, and description thereof is appropriately omitted.

In the first embodiment, the open-ended resonators constituting the first resonator 1 and the second resonator 2 are so-called open-ring resonators; however, resonators of the other structures may be adopted as the open-ended resonators. Basically, it is satisfactory if arrangement is made such that a pair of resonators that are mirror symmetrical to each other are formed on the front and back of one substrate, respectively, and at the position in closest proximity to each other (opposing portions of the substrates) between two substrates facing each other, respective open-ended portions thereof are facing each other and respective central portions thereof are facing each other.

Figure 13A:
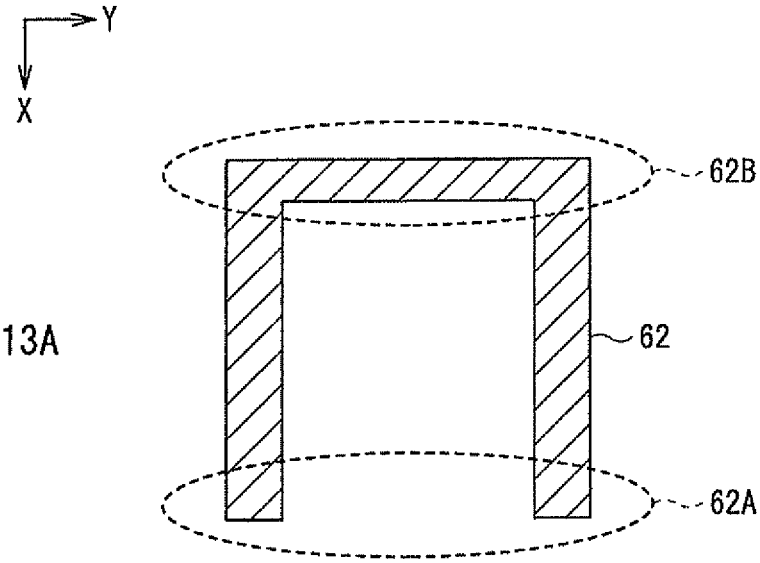
FIG. 13 is a plan view illustrating an exemplary configuration of a major part of a signal transmission device according to a second embodiment of the present disclosure.
Figure 13B:
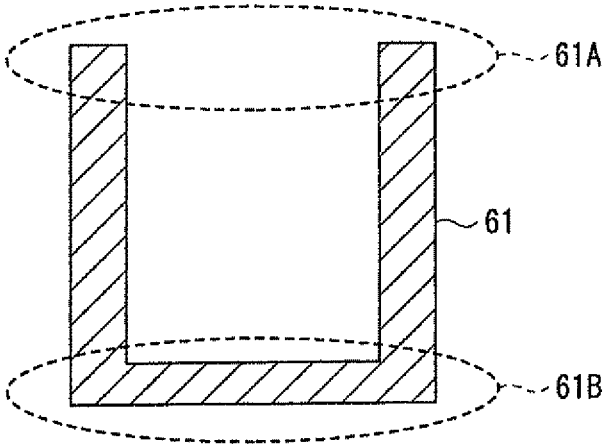

FIGS. 13A and 13B illustrate exemplary open-ended resonators having another structure. FIGS. 13A and 13B illustrate a structure of a pair of open-ended resonators 61 and 62 each of which is U-shaped half wavelength resonator. The pair of the open-ended resonators 61 and 62 may be adopted in place of the first open-ended resonators 11 and 12 and the second open-ended resonators 21 and 22 which constitute the first resonator 1, for example. In this case, the positional relationship between two adjacent open-ended resonators is configured in the same manner as in the case of the first open-ended resonators 11 and 12 and the second open-ended resonators 21 and 22. That is, the resonators are arranged in the first substrate 10 and the second substrate 20 such that an open-ended portion 61A of the open-ended resonator 61 faces a central portion 628 of the open-ended resonator 62, and that a central portion 61B of the open-ended resonator 61 faces an open-ended portion 62A of the open-ended resonator 62. In addition, the open-ended resonators 61 and 62 are arranged such that, at the position in closest proximity to each other (opposing portions of the substrates) between the first substrate 10 and the second substrate 20, the respective open-ended portions thereof face each other and the respective central portions thereof face each other. Also in this case, in the resonance mode having the resonance frequency f1 that is the lowest frequency among a plurality of resonance modes, for example, the open-ended resonators 61 and 62 in closest proximity to each other between the first substrate 10 and the second substrate 20 have the same current direction (both in the clockwise direction or both in the counterclockwise direction), so that electric field distribution between the open-ended resonators is substantially uniform.

[Third Embodiment]

Next, a signal transmission device according to a third embodiment of the present disclosure will be described. It is to be noted that, the same reference numerals are given to the same components as those of the first embodiment or second embodiment, and description thereof is appropriately omitted.

Figure 14A:
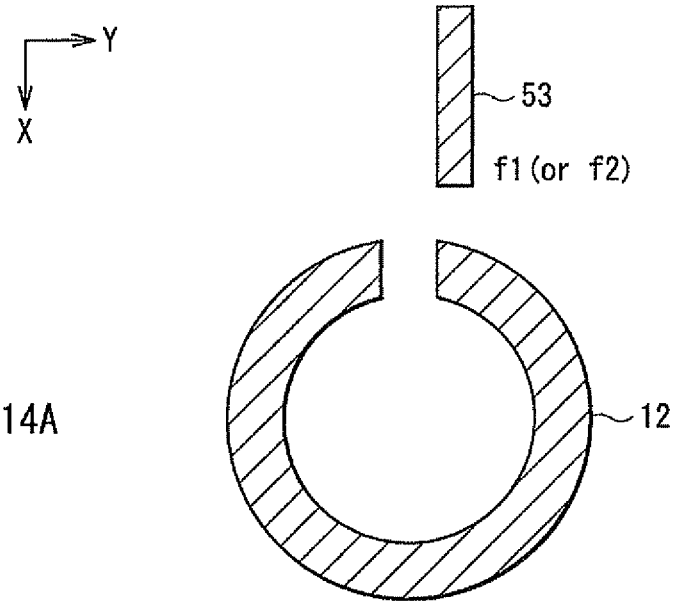
FIG. 14 is a plan view illustrating an exemplary configuration of a major part of a signal transmission device according to a third embodiment of the present disclosure.

In the signal transmission device shown in FIG. 1, the first signal-lead electrode 51 is physically and directly connected to the first open-ended resonator 12 formed in the first substrate 10 in order to establish electrical connection. Alternatively, it is possible to employ a signal-lead electrode electromagnetically coupled to the first resonator 1 with a space therebetween. For example, as shown in FIG. 14A, a first signal-lead electrode 53 spaced from the first open-ended resonator 12 may be created on the front of the first substrate 10. In this case, the first signal-lead electrode 53 is configured as a resonator which resonates at the resonance frequency f1 (or f2) that is the same as the resonance frequency f1 (or f2) of the first resonator 1. Thus, the first signal-lead electrode 53 and the first resonator 1 are electromagnetically coupled to each other at the resonance frequency f1 (or f2).

Figure 14B:
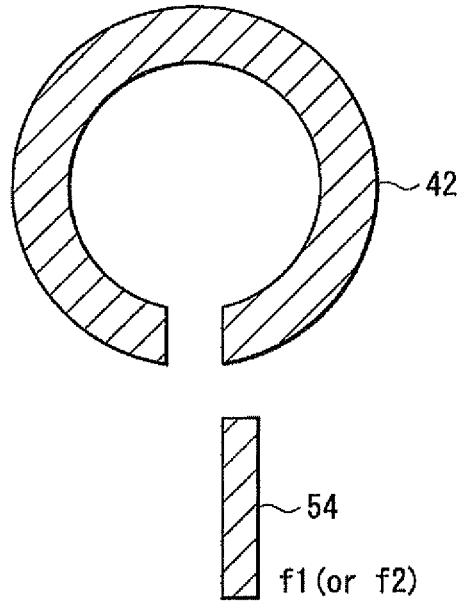

Likewise, in the signal transmission device shown in FIG. 1, the second signal-lead electrode 52 is physically and directly connected to the fourth open-ended resonator 42 formed in the second substrate 20 in order to establish electrical connection. Alternatively, it is possible to employ a signal-lead electrode electromagnetically coupled to the first resonator 1 with a space therebetween. For example, as shown in FIG. 14B, a second signal-lead electrode 54 spaced from the fourth open-ended resonator 42 may be created on the back of the second substrate 20. In this case, the second signal-lead electrode 54 is configured as a resonator which resonates at the resonance frequency f1 (or f2) that is the same as the resonance frequency f1 (or f2) of the second resonator 2. Thus, the second signal-lead electrode 54 and the second resonator 2 are electromagnetically coupled to each other at the resonance frequency f1 (or f2).

[Other Embodiments]

The present disclosure is not limited to the embodiment and various modifications may be made. For example, while the first resonator 1 and the second resonator 2 of the first embodiment have substantially the same resonator structure with each other as illustrated in FIGS. 4A and 4B, the second resonator 2 (or the first resonator 1) may have another resonator structure, for example.

In the first embodiment, two open-ended resonators are formed in each of the first substrate 10 and the second substrate 20. Alternatively, it is possible to create in one of the substrates only one open-ended resonator configuring the first resonator 1 or the second resonator 2. For example, it is possible to create, in the second substrate 20, only the second open-ended resonator 21 as a component of the first resonator 1. Likewise, in the case of the second resonator 2, it is possible to create, in the second substrate 20, only the fourth open-ended resonator 41 as a component of the second resonator 2.

In addition, in the first embodiment, the first resonator 1 and the second resonator 2 are made up of two substrates: the first substrate 10 and the second substrate 20. Alternatively, the first resonator 1 and the second resonator 2 may be made up of three or more substrates disposed facing each other. For example, the third substrate may be created on the opposite side of the first substrate 10 (back of the second substrate 20) so as to face the second substrate 20 with a space (inter-substrate distance Da) therebetween. In addition, a plurality of open-ended resonators may be created in the third substrate similarly to the first substrate 10 and the second substrate 20. In this case, the first resonator 1 may be made up of open-ended resonators formed in the first region in the first substrate 10, the second substrate 20, and the third substrate, and the second resonator 2 may be made up of open-ended resonators formed in the second region.

Further, in the first embodiment, the first signal-lead electrode 51 and the second signal-lead electrode 52 are formed on the first substrate 10 side and the second substrate 20 side, respectively, and signal transmission is performed between substrates. Alternatively, the signal-lead electrodes may be formed on the same substrate in order to perform signal transmission in the substrate. For example, signal transmission in the second substrate 20 may be performed in a configuration where the first signal-lead electrode 51 formed on the bottom of the second substrate 20 is connected to an end of the second open-ended resonator 22. In this case, although the signal transmission direction is in the second substrate 20, the signal is transmitted with use of the resonator of the first substrate 10 (with use of the volume in the vertical direction), and therefore, when the device is used as a filter for selecting a given frequency and transmitting the selected signal, for example, plane area may be reduced in comparison with the case where only the electrode pattern on the second substrate 20 is used for the signal transmission. In other words, while reducing the plane area, signal may be transmitted in the substrate as a filter.

In addition, while the first resonator 1 and the second resonator 2 are arranged in parallel in the first embodiment, a configuration in which three or more resonators arranged in parallel may be adopted. In this case, it is only necessary that open-ended resonators in closest proximity to each other between different substrates have the same current direction. Moreover, while the first substrate 10 and the second substrate 20 have the same relative permittivity in the first embodiment, the first substrate 10 and the second substrate 20 may have different relative permittivities. In this case, it is only necessary that a layer having relative permittivity different from the relative permittivity of at least one of the first substrate 10 and the second substrate 20 is sandwiched therebetween. The same applies to the other embodiments. Further, the signal transmission device of the embodiments of the present disclosure includes signal transmission devices for transmitting and/or receiving electric power, in addition to signal transmission devices for transmitting and/or receiving analog signal and digital signal.

The present application contains subject matter related to that disclosed in Japanese Priority Patent Application JP 2010-194557 filed in the Japan Patent Office on Aug. 31, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal transmission device comprising:

a first and a second substrates disposed facing each other in a first direction with a space therebetween;

a first resonator including a plurality of first open-ended resonators and a single or a plurality of second open-ended resonators, the plurality of first open-ended resonators being formed in a first region of the first substrate and being electromagnetically coupled to each other in the first direction, the single or the plurality of second open-ended resonators being formed in a region of the second substrate corresponding to the first region, and the plurality of second open-ended resonators being electromagnetically coupled to each other in the first direction; and a second resonator electromagnetically coupled to the first resonator, the second resonator performing signal transmission between the first resonator and the second resonator through the electromagnetic coupling therebetween, wherein the plurality of first open-ended resonators include a first first-open-ended resonator and a second first-open-ended resonator, open ends of the first first-open-ended resonator facing a central portion of the second first-open-ended resonator, a central portion of the first first-open-ended resonator facing open ends of the second first-open-ended resonator, when the plurality of second open-ended resonators are employed, the plurality of second open-ended resonators include a first second-open-ended resonator and a second second-open-ended resonator, open ends of the first second-open-ended resonator facing a central portion of the second second-open-ended resonator, a central portion of the first second-open-ended resonator facing open ends of the second second-open-ended resonator, and the first open-ended resonator and the second open-ended resonator in closest proximity to each other in the first resonator are arranged such that the respective open ends thereof face each other and the respective central portions thereof face each other.

2. The signal transmission device according to claim 1, wherein the second resonator includes a plurality of third open-ended resonators and a single or a plurality of fourth open-ended resonators, the plurality of third open-ended resonators being formed in a second region of the first substrate and being electromagnetically coupled to each other in the first direction, the single or the plurality of fourth open-ended resonators being formed in a region of the second substrate corresponding to the second region, and the plurality of fourth open-ended resonators being electromagnetically coupled to each other in the first direction, the third open-ended resonators include a first third-open-ended resonator and a second third-open-ended resonator, open ends of the first third-open-ended resonator facing a central portion of the second third-open-ended resonator, a central portion of the first third-open-ended resonator facing open ends of the second third-open-ended resonator, when the plurality of fourth open-ended resonators are employed, the plurality of fourth open-ended resonators include a first fourth-open-ended resonator and a second fourth-open-ended resonator, open ends of the first fourth-open-ended resonator facing a central portion of the second fourth-open-ended resonator, a central portion of the first fourth-open-ended resonator facing open ends of the second fourth-open-ended resonator, and the third open-ended resonator and the fourth open-ended resonator in closest proximity to each other in the second resonator are arranged such that the respective open ends thereof face each other and the respective central portions thereof face each other.

3. The signal transmission device according to claim 2, further comprising:

a first signal-lead electrode fowled in the first substrate, the first signal-lead electrode being physically and directly connected to one of the plurality of first open-ended resonators, or being electromagnetically coupled to one of the plurality of first open-ended resonators while providing a spacing between the first signal-lead electrode and the first resonator; and a second signal-lead electrode formed in the second substrate, the second signal-lead electrode being physically and directly connected to the single fourth open-ended resonator or to one of the plurality of fourth open-ended resonators, or being electromagnetically coupled to the single fourth open-ended resonator or one of the plurality of fourth open-ended resonators while providing a spacing between the second signal-lead electrode and the second resonator, wherein the signal transmission device performs signal transmission between the first substrate and the second substrate.

4. The signal transmission device according to claim 2, further comprising:

a first signal-lead electrode formed in the second substrate, the first signal-lead electrode being physically and directly connected to the single second open-ended resonator or to one of the plurality of second open-ended resonators, or being electromagnetically coupled to the single second open-ended resonator or to one of the plurality of second open-ended resonators while providing a spacing between the first signal-lead electrode and the first resonator; and a second signal-lead electrode formed in the second substrate, the second signal-lead electrode being physically and directly connected to the single fourth open-ended resonator or to one of the plurality of fourth open-ended resonators, or being electromagnetically coupled to the single fourth open-ended resonator or to one of the plurality of fourth open-ended resonators while providing a spacing between the second signal-lead electrode and the second resonator, wherein the signal transmission device performs signal transmission within the second substrate.

5. The signal transmission device according to claim 2, wherein, when the plurality of first open-ended resonators and the single or plurality of second open-ended resonators are electromagnetically coupled to each other in a hybrid resonance mode, the first resonator acts as a coupled resonator collectively resonating at a first resonance frequency, and when the first and the second substrates are spaced from each other to fail to be electromagnetically coupled to each other, each of an independent resonance frequency of the plurality of first open-ended resonators and an independent resonance frequency of the plurality of second open-ended resonators is different from the first resonance frequency, and when the plurality of third open-ended resonators and the single or the plurality of fourth open-ended resonators are electromagnetically coupled to each other in the hybrid resonance mode, the second resonator acts as a coupled resonator collectively resonating at the first resonance frequency, and when the first and the second substrates are spaced from each other to fail to be electromagnetically coupled to each other, each of an independent resonance frequency of the plurality of third open-ended resonators and an independent resonance frequency of the plurality of fourth open-ended resonators is different from the first resonance frequency.

6. A filter comprising:

a first and a second substrates disposed facing each other in a first direction with a space therebetween;

a first resonator including a plurality of first open-ended resonators and a single or a plurality of second open-ended resonators, the plurality of first open-ended resonators being formed in a first region of the first substrate and being electromagnetically coupled to each other in the first direction, the single or the plurality of second open-ended resonators being formed in a region of the second substrate corresponding to the first region, and the plurality of second open-ended resonators being electromagnetically coupled to each other in the first direction; and a second resonator electromagnetically coupled to the first resonator, the second resonator performing signal transmission between the first resonator and the second resonator through the electromagnetic coupling therebetween, wherein the plurality of first open-ended resonators include a first first-open-ended resonator and a second first-open-ended resonator, open ends of the first first-open-ended resonator facing a central portion of the second first-open-ended resonator, a central portion of the first first-open-ended resonator facing open ends of the second first-open-ended resonator, when the plurality of second open-ended resonators are employed, the plurality of second open-ended resonators include a first second-open-ended resonator and a second second-open-ended resonator, open ends of the first second-open-ended resonator facing a central portion of the second second-open-ended resonator, a central portion of the first second-open-ended resonator facing open ends of the second second-open-ended resonator, and the first open-ended resonator and the second open-ended resonator in closest proximity to each other in the first resonator are arranged such that the respective open ends thereof face each other and the respective central portions thereof face each other.

7. An inter-substrate communication device comprising:

a first and a second substrates disposed facing each other in a first direction with a space therebetween;

a first resonator including a plurality of first open-ended resonators and a single or a plurality of second open-ended resonators, the plurality of first open-ended resonators being formed in a first region of the first substrate and being electromagnetically coupled to each other in the first direction, the single or the plurality of second open-ended resonators being formed in a region of the second substrate corresponding to the first region, and the plurality of second open-ended resonators being electromagnetically coupled to each other in the first direction;

a second resonator including a plurality of third open-ended resonators and a single or a plurality of fourth open-ended resonators, the plurality of third open-ended resonators being formed in a second region of the first substrate and being electromagnetically coupled to each other in the first direction, the single or the plurality of fourth open-ended resonators being formed in a region of the second substrate corresponding to the second region, the plurality of fourth open-ended resonators being electromagnetically coupled to each other in the first direction, and the second resonator being electromagnetically coupled to the first resonator to perform signal transmission between the first resonator and the second resonator;

a first signal-lead electrode formed in the first substrate, the first signal-lead electrode being physically and directly connected to one of the plurality of first open-ended resonators, or being electromagnetically coupled to one of the plurality of first open-ended resonators while providing a spacing between the first signal-lead electrode and the first open-ended resonator; and a second signal-lead electrode formed in the second substrate, the second signal-lead electrode being physically and directly connected to one of the plurality of fourth open-ended resonators, or being electromagnetically coupled to one of the plurality of the fourth open-ended resonators while providing a spacing between the second signal-lead electrode and the fourth open-ended resonator, wherein the plurality of first open-ended resonators include a first first-open-ended resonator and a second first-open-ended resonator, open ends of the first first-open-ended resonator facing a central portion of the second first-open-ended resonator, a central portion of the first first-open-ended resonator facing open ends of the second first-open-ended resonator, when the plurality of second open-ended resonators are employed, the plurality of second open-ended resonators include a first second-open-ended resonator and a second second-open-ended resonator, open ends of the first second-open-ended resonator facing a central portion of the second second-open-ended resonator, a central portion of the first second-open-ended resonator facing open ends of the second second-open-ended resonator, the plurality of third open-ended resonators include a first third-open-ended resonator and a second third-open-ended resonator, open ends of the first third-open-ended resonator facing a central portion of the second third-open-ended resonator, a central portion of the first third-open-ended resonator facing open ends of the second third-open-ended resonator, when the plurality of fourth open-ended resonators are employed, the plurality of fourth open-ended resonators include a first fourth-open-ended resonator and a second fourth-open-ended resonator, open ends of the first fourth-open-ended resonator facing a central portion of the second fourth-open-ended resonator, a central portion of the first fourth-open-ended resonator facing open ends of the second fourth-open-ended resonator, the first open-ended resonator and the second open-ended resonator in closest proximity to each other in the first resonator are arranged such that the respective open ends thereof face each other and the respective central portions thereof face each other, the third open-ended resonator and the fourth open-ended resonator in closest proximity to each other in the second resonator are arranged such that the respective open ends thereof face each other and the respective central portions thereof face each other, and the inter-substrate communication device performs signal transmission between the first substrate and the second substrate.

* * * * *